US005868556A

United States Patent [19]

Umemura

[11] Patent Number: 5,868,556

[45] Date of Patent: Feb. 9, 1999

[54] SWASH-PLATE TYPE COMPRESSOR

[75] Inventor: Yukio Umemura, Yokohama, Japan

[73] Assignee: Calsonic Corporation, Tokyo, Japan

[21] Appl. No.: 755,336

[22] Filed: Nov. 22, 1996

[30] Foreign Application Priority Data

| | | | |
|---|---|---|---|
| Nov. 24, 1995 | [JP] | Japan | 7-306135 |
| Nov. 24, 1995 | [JP] | Japan | 7-306136 |
| Nov. 15, 1996 | [JP] | Japan | 8-304939 |

[51] Int. Cl.[6] ..... F04B 1/12; F04B 27/08

[52] U.S. Cl. ..... 417/269; 92/71; 91/499

[58] Field of Search ..... 917/269; 92/71; 91/499

[56] References Cited

U.S. PATENT DOCUMENTS

| | | | |
|---|---|---|---|
| 4,428,718 | 1/1984 | Skinner | 417/222 |
| 5,382,139 | 1/1995 | Kawaguchi et al. | 417/269 |
| 5,461,967 | 10/1995 | Burkett et al. | 417/269 |
| 5,630,353 | 5/1997 | Mittlefehldt et al. | 417/269 |

FOREIGN PATENT DOCUMENTS

| | | | |
|---|---|---|---|
| 518432 | 2/1931 | Germany | 417/269 |
| 64-1668 | 1/1989 | Japan . | |

*Primary Examiner*—Charles G. Freay
*Attorney, Agent, or Firm*—Foley & Lardner

[57] ABSTRACT

A swash-plate type compressor comprises a drive shaft, at least one plunger piston, a cylinder block rotatably supporting the drive shaft and defining therein at least one cylinder chamber or bore, the cylinder chamber slidably accommodating the piston to permit an axial reciprocal sliding movement of the piston in the cylinder chamber, a swash plate rotatably mounted on the drive shaft, and a linkage provided between the drive shaft and the swash plate for causing a rotational movement of the swash plate in synchronization with rotation of the drive shaft, while permitting a wobbling movement of the swash plate. The piston includes a bottom section having a recessed portion for receiving a pair of semi-spherical shoes and for slidably holding the swashplate side walls between the shoe pair for the axial reciprocal sliding movement of the piston, and a main skirt section having a through-opening extending in a rotational direction of the swash plate.

22 Claims, 14 Drawing Sheets

SWASH-PLATE TYPE COMPRESSOR

BACKGROUND OF THE INVENTION

1. Field of the Invention

The present invention relates to a swash-plate type compressor suitable for use in an automotive air conditioning system, and specifically to a piston structure for a swash-plate type compressor employing an oil-mist lubrication system in which some compressor lubricant is mixed in refrigerant and thus almost all compressor oil is circulating in the system together with refrigerant.

2. Description of the Prior Art

In recent years, there have been proposed and developed various swashplate type compressors in which a swash plate is mounted on a compressor shaft (a drive shaft) for actuating a plurality of axial pistons, forcing them to move back and forth in cylinders of the compressor, as the shaft is rotated. One is a fixed swashplate type compressor in which the slope angle between the swash plate and the drive shaft is fixed to a constant value, and the other is a variable-displacement, swashplate type compressor in which the slope angle of the swash plate is variable so as to maintain the suction side essentially at a desired pressure level. Several swashplate type air conditioning compressors are in use in automotive applications. A typical variable-displacement, swashplate type air conditioning compressor has been disclosed in Japanese Patent Second Publication No. 64-1668. Referring to FIG. 16, there is shown a prior art swashplate type compressor as disclosed in the Japanese Patent Second Publication No. 64-1668. As seen in FIG. 16, in the conventional compressor, each piston 22 is directly connected to a swash plate 43 by means of two opposing essentially semi-spherical shoes 23, without providing any other wobble which may be engaged with the swash plate through a journal of the swash plate and connected to the pistons through piston rods on older models. Note that for the sake of a simple illustration, only one of the plurality of pistons 22 is shown in FIG. 16. The swash plate 43 is rotated in synchronization with rotation of the compressor shaft 11. The piston 22 is usually comprised of a substantially cylindrical top (or a piston crown) 22*a*, which is reciprocally accommodated in the cylinder chamber 12*a* defined in the cylinder block 12 and formed with a cylindrical hollow 24, and a bottom (or an axially extended piston skirt) 22*b* formed with a substantially U-shaped recessed portion through which the piston 22 is mechanically linked to the swash plate 43 by virtue of two opposing semi-spherical shoes 23. Actually, the U-shaped recessed portion of the piston skirt 22*b* is further formed with two opposing spherical-surface embossed portions axially spaced apart from each other. The two opposing spherical-surface embossed portions slidably receive the respective semi-spherical surfaces of the shoes 23 so that both side walls of the swash plate 43 is slidably sandwiched between two opposing flat surfaces of the shoes 23. The rotational movement of the drive shaft 11 results in oscillating or wobbling and rotational movement of the swash plate 43. The wobbling/rotational movement of the swash plate 43 thus reciprocates the piston 22 in its axial direction. As may be appreciated, on the upstroke (compression stroke) or during rightward motion of the piston (FIG. 16), or on the downstroke (suction stroke) or during leftward motion (FIG. 16) of the piston, side force is created at both sides of the piston. In the prior art swashplate type compressor shown in FIG. 16, since the piston crown 22*a* is formed into a substantially cylindrical shape, oil lubrication between the outer periphery of the cylindrical piston crown and the inner periphery of the cylinder chamber (or the cylinder bore)12*a* is still insufficient. To prevent excessive friction which may be generated in the cylinder owing to the side force, and to ensure smooth reciprocating motion of the piston 22, and to reduce undesired piston wear and cylinder wear, it is desirable to adequately lubricate sliding surfaces between the inner peripheral wall of the cylinder chamber 12*a* and the outer peripheral wall of the piston 22 with a compressor oil circulating in the system together with the refrigerant.

SUMMARY OF THE INVENTION

Accordingly, it is an object of the invention to provide an improved swash-plate type compressor which avoids the foregoing disadvantages of the prior art.

It is another object of the invention to provide a piston structure for a swash-plate type compressor employing an oil-mist lubrication system, which can assure a simple and inexpensive compressor arrangement, while ensuring a smooth reciprocating motion of pistons slidingly accommodated in the cylinders of the compressor.

In order to accomplish the aforementioned and other objects of the invention, a swash-plate type compressor comprises a drive shaft, at least one piston, a cylinder block rotatably supporting the drive shaft and defining therein at least one cylinder chamber, the cylinder chamber slidably accommodating the piston to permit an axial reciprocal sliding movement of the piston in the cylinder chamber, a swash plate rotatably mounted on the drive shaft, and a linkage having a driven connection with the drive shaft and drivingly connected to the swash plate for causing a rotational movement of the swash plate in synchronization with rotation of the drive shaft, while permitting a wobbling movement of the swash plate, the piston including a bottom section having a recessed portion for receiving a pair of shoes and for slidably holding side walls of the swash plate between the shoes for the axial reciprocal sliding movement of the piston, and a main skirt section having a through-opening extending in a rotational direction of the swash plate. It is preferable that the main skirt section has a shaft portion disposed in the through-opening and aligned coaxially with respect to the axis of the piston for transmitting an axial force input from an end of the piston.

According to another aspect of the invention, a swash-plate type compressor employing an oil-mist lubrication system in which system some compressor lubricating oil is mixed in refrigerant, comprises a drive shaft, at least one piston, a cylinder block rotatably supporting the drive shaft and defining therein at least one cylinder chamber and a crankcase chamber, the cylinder chamber slidably accommodating the piston to permit an axial reciprocal sliding movement of the piston in the cylinder chamber, a swash plate rotatably mounted on the drive shaft, and a linkage having a driven connection with the drive shaft and drivingly connected to the swash plate for causing a rotational movement of the swash plate in synchronization with rotation of the drive shaft, while permitting a wobbling movement of the swash plate, the piston including a bottom section having a recessed portion for receiving a pair of shoes and for slidably holding side walls of the swash plate between the shoes for the axial reciprocal sliding movement of the piston, and a main skirt section having a through-opening extending in a rotational direction of the swash plate for feeding compressor lubricating oil mist in the crankcase chamber through the through-opening to an inner peripheral surface of the cylinder chamber. The swash-plate type compressor may further comprise a piston ring section and a connecting shaft portion connected between the main skirt section and the piston ring section and coaxially aligned with an axis of the piston for transmitting an axial force applied to the piston and for defining an annular space in conjunction with the inner peripheral surface of the cylinder chamber. Preferably, the main skirt section may be formed with an axially-extending notched portion for intercommunicating the crankcase chamber and the annular space for lubrication of the inner peripheral surface of the cylinder chamber. The through-opening may include an upstream opening defined at an upstream side with respect to the rotational direction of the swash plate and a downstream opening defined at a downstream side with respect to the rotational direction, and the upstream and downstream openings define an outside sliding surface and an inside sliding surface, and the main skirt section is formed with circumferentially-extending webbed portions projected from the outside and inside sliding surfaces toward the downstream opening so that the circumferentially-extending webbed portions are contoured along an outer peripheral surface of the main skirt section. Alternatively, the main skirt section may be formed with a laterally-extending webbed portion provided substantially midway between the outside and inside sliding surfaces so that the laterally-extending webbed portion is projected into the through-opening. It is preferable that the laterally-extending webbed portion is point-symmetrical with respect to the axis of the piston.

DESCRIPTION OF THE PREFERRED EMBODIMENTS

First Embodiment

Figure 1:
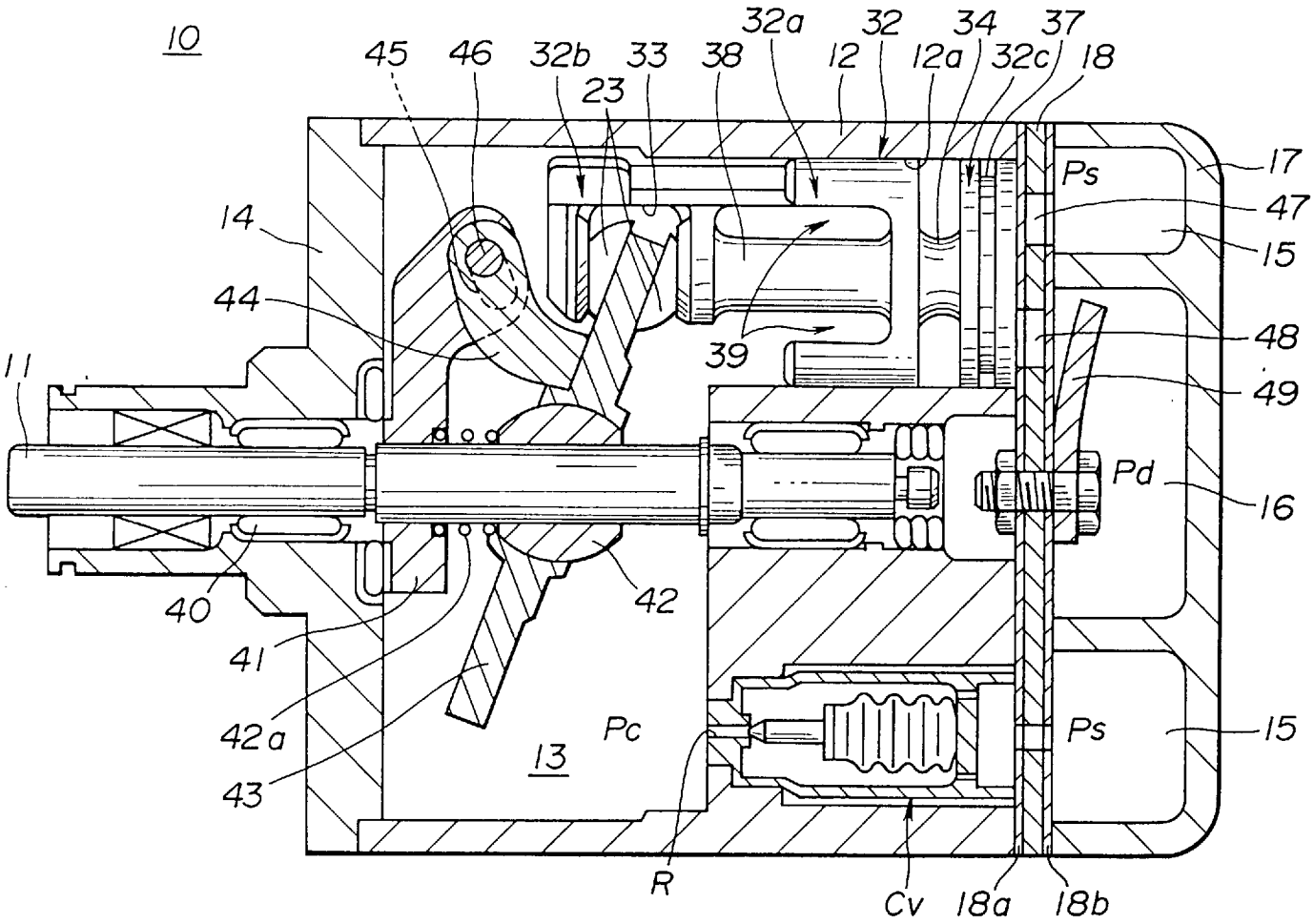
FIG. 1 is a longitudinal cross-sectional view illustrating a first embodiment of a variable displacement, swashplate type compressor made according to the present invention.
Figure 16:
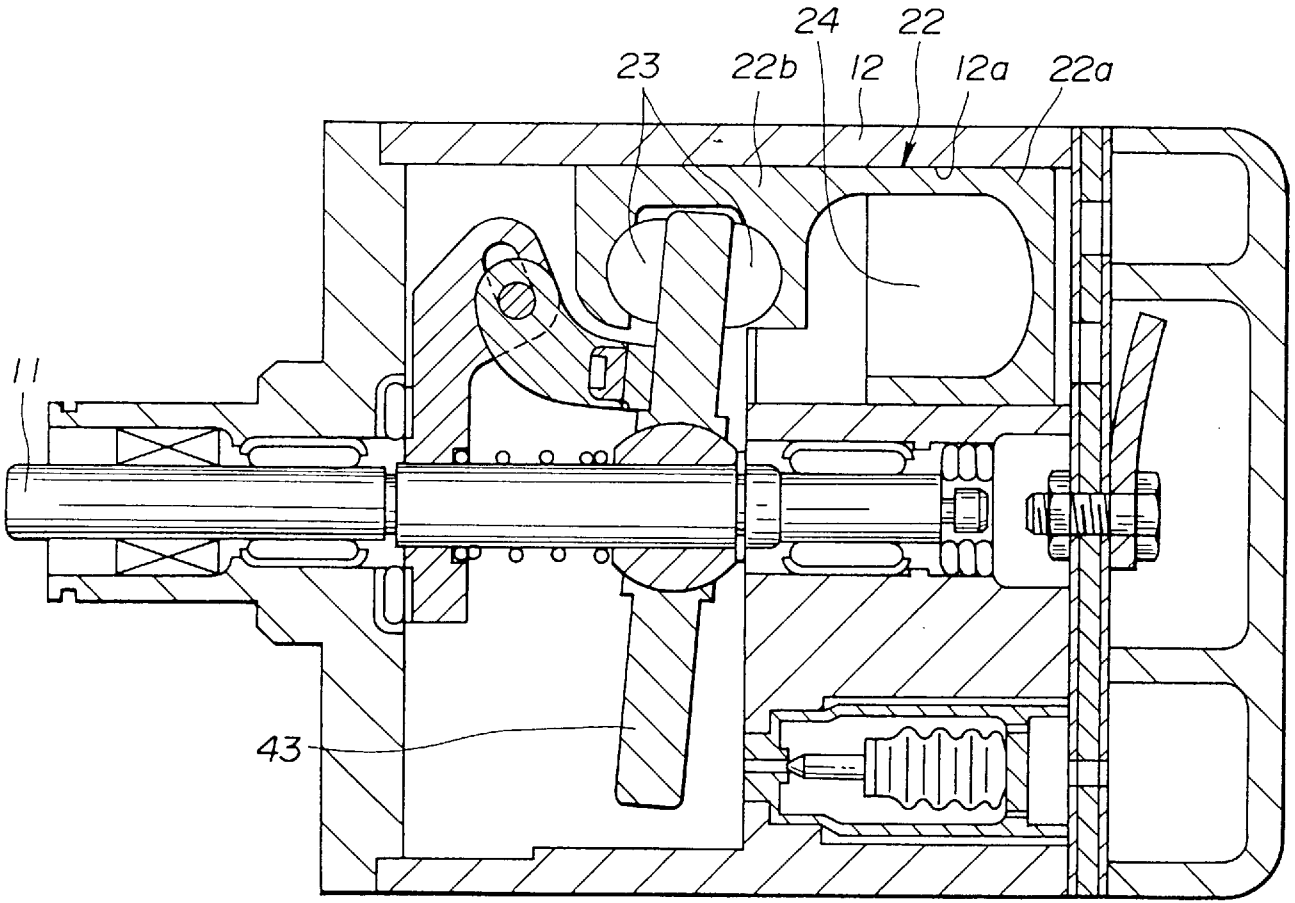
FIG.16 (PRIOR ART)
FIG. 16 is a longitudinal cross-sectional view illustrating a prior art variable displacement, swashplate type compressor.

Referring now to the drawings, particularly to FIGS. 1 through 4C, the variable displacement, swashplate type compressor 10 of the first embodiment includes a compressor shaft 11 (or a drive shaft), a cylinder block (or a crankcase) 12 which rotatably receives the drive shaft 11 and is formed with a plurality of axially-extending cylinder chambers 12*a*, being circumferentially and equi-distant spaced with each other with respect to the axis of the drive shaft 1, a plurality of plunger pistons 32 being reciprocally accommodated in the associated cylinder chamber 12*a*, and a swash plate 43 being rotatable in synchronization with rotation of the drive shaft 11 and simultaneously movable back and forth in accordance with axial reciprocal sliding movement of each of the pistons 32. The same reference numerals used in the prior art disclosure of FIG. 16 will be applied to the corresponding elements used in the first embodiment of FIGS. 1 to 4C, for the purpose of comparison of the first embodiment with the prior art piston structure. As seen in FIG. 1, the piston 32 is comprised of a main section (or an intermediate skirt section) 32*a*, a bottom section 32*b*, and a piston ring section (or a head section) 32*c*. The piston ring section 32*c* and the main skirt section 32*a* are integrally connected to each other through a connecting shaft portion 34 having a diameter smaller than that of the main skirt section 32*a*. The bottom section 32*b* of the piston is formed with a substantially U-shaped recessed portion 33. The U-shaped recessed portion 33 is further formed with two opposing spherical-surface embossed portions 35 through which the piston 32 is mechanically linked to the swash plate 43 by virtue of the two opposing semi-spherical shoes 23, such that the two opposing spherical-surface embossed portions 35 slidably receive the respective semi-spherical surfaces of the shoes 23 and so that both side walls of the swash plate 43 are slidably sandwiched between the two opposing flat surfaces of the shoes 23 at the perimeter of the swash plate. To ensure designated oscillating movement of the swash plate 43 within the internal space of the crankcase or the cylinder block 12 and thus to provide reciprocating motion of each piston 32 within the cylinder chamber 12*a*, synchronous to rotation of the drive shaft 11, the drive shaft 11 is mechanically linked to the swash plate by means of a linkage (denoted by 41, 44, 45 and 46) as will be more fully described later. The internal space 13 of the cylinder block 12 is often called "crankcase chamber". The internal space will be hereinafter referred to as a "crank chamber". For the sake of a simple illustration, although only one piston/cylinder chamber is shown in FIG. 1, the cylinder block defines therein a plurality of axially-extending cylinder chambers 12*a* which are circumferentially and equi-distant spaced with each other, with respect to the axis of the drive shaft 11. The cylinder block 12 is formed of a molded material having a high wear and abrasion resistance, such as aluminum alloy of a high silicon content molded by means of die-casting. There is a greatly increased tendency for such aluminum alloy to maintain lubricating-oil film on its surface, and thereby ensuring smooth sliding motion of the piston. A front housing 14 is fixedly connected to the left end of the cylinder block 12 by means of bolts (not shown) such that the front housing 14 hermetically covers the left-hand opening of the cylinder block in a fluid-tight fashion, whereas a rear housing 17 is fixedly connected to the right end of the cylinder block 12 by means of bolts (not shown) in such a manner as to sandwich all of a suction reed valve seat or valve disk 18*a*, a rear discharge plate 18 and a discharge reed valve seat or valve disk 18*b* in conjunction with the right end of the cylinder block 12. The rear housing 17 defines therein a suction chamber 15 into which the compressor lubricant-refrigerant mixture, circulating in the system, returns in the form of the gaseous refrigerant and oil mist, and a discharge chamber 16 into which the pressurized gaseous refrigerant is introduced. The rear discharge plate 18 is formed with a suction port or an inlet port 47 for communicating the cylinder chamber 12*a* with the suction chamber 15 through the suction reed valve seat 18*a*, and a discharge port 48 for communicating the cylinder chamber 12*a* with the discharge chamber 16 through the discharge reed valve seat 18*b*. A part denoted by 49 is a discharge-reed-valve back-up strap or retainer for limiting the extent of opening of each of the discharge reed valves provided on the valve seat 18*b*. As appreciated, the reed valves are provided respectively on the suction reed valve seat 18*a* and the discharge reed valve seat 18*b*, for controlling suction and discharge of the lubricant-refrigerant mixture into or from the compressor. The drive shaft 11 is centrally supported in the compressor and rotatably supported by the boss-like portion of the front housing 14 through a radial bearing 40 such as a radial needle bearing. The previously-noted linkage for the swash plate 43 includes a drive lug 41 fixedly connected to the drive shaft 11 for rotation together with the drive shaft 11, a ball sleeve 42 slidably mounted on the shaft 11, and a return spring 42*a* having a spherical surface and axially slidably provided on the outer periphery of the shaft 11 between the drive lug 41 and the ball sleeve 42. The swash plate 43 is engaged with the ball sleeve 42 such that the inner peripheral concave surface of the swash plate is slidably mounted on the outer spherical surface of the ball sleeve 42. The linkage for the swash plate also includes an arm-like support link 44 fixedly connected to the swash plate 43. The drive lug 41 is formed with a guide slot 45 for pin-connection to a cross pin 46 fixedly connected to the support link 44. The guide slot 45 is formed to guide the angulation of the swash plate 43. Although it is not clearly shown in the drawings, one end of the cross pin 46 is formed with a headed portion and the cross pin 46 is retained in place by a snap ring (not shown) provided on the other end, in order to serve as a journal pin and to ensure the pin connection, ordinarily. The return spring 42*a* is designed to initiate axial return-movement of the ball sleeve 42. With the previously-noted arrangement, the cross pin 46 is movable radially with respect to the drive lug 41, and also the swash plate 43 is rotatable about the center of the ball sleeve 42, and thus the angle of the swash plate 43 is variable with respect to the axis of the drive shaft 11 to thereby infinitely vary the stroke of the pistons. In the shown embodiment, although the drive lug 41 is separated from the sleeve 42, the drive lug may be mounted on the sleeve without providing sliding engagement between the sleeve 42 and the swash plate 43, such as being disclosed in U.S. Pat. No. 4,428,718, issued Jan. 31, 1984 to Timothy J. Skinner, the teachings of which are hereby incorporated by reference. The compressor 10 of the first embodiment includes a control valve Cv for opening and closing a communication port R through which the suction chamber 15 is communicated with the crank chamber 13. Actually, the control valve Cv employed in the compressor 10 of the embodiment is similar to a suction-pressure biased gas-filled bellows type pressure control valve which has been disclosed in the Japanese Patent Second Publication No. 64-1668. For example, in case of high ambient temperature and thus a high heat load above a set point, the suction pressure Ps may exceed a set pressure level of the gas-filled bellows of the control valve Cv, thereby resulting in contraction of the bellows. The contraction of the bellows results in axial movement of the tip of the needle of the control valve apart from the communication port R, and as a result the opening of the communication port R is increased. The increased opening of the port R reduces the crank-chamber pressure Pc. With the pressure Pc reduced, the crankcase-suction pressure differential |Pd−Pc| between the discharge pressure Pd and the crank-chamber pressure Pc tends to rise. The elevation of the pressure differential |Pd−Pc| results in an increase in the slope angle of the swash plate 43. In contrast to the above, in case of low ambient temperature or low in-car temperature and thus a low heat load below the set point, the suction pressure Ps may drop the set pressure level of the bellows of the control valve Cv, thereby resulting in expansion of the bellows. The expansion of the bellows results in axial movement of the tip of the needle of the control valve toward the communication port R, and as a result the opening of the communication port R is decreased. The decreased opening of the port R maintains the crank-chamber pressure Pc at a comparatively high level. With the pressure Pc of a comparatively high pressure level, the crankcase-suction pressure differential |Pd−Pc| tends to fall. The drop in the pressure differential |Pd−Pc| results in a decrease in the slope angle of the swash plate 43. The contraction or expansion of the bellows of the control valve Cv, based on the magnitude of heat load, functions to maintain the suction pressure Ps at a set suction pressure control point. As set forth above, the displacement or capacity of the compressor is variably controlled depending on the magnitude of heat load, by way of proper adjustment of the slope angle of the swash plate.

Hereinbelow described in detail is the piston structure of the swashplate type compressor of the first embodiment.

Figure 2:
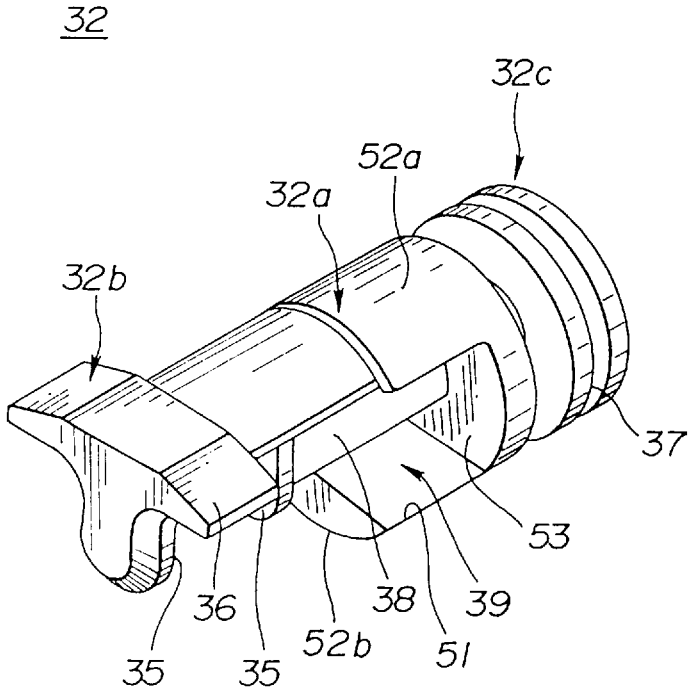
FIG. 2 is a perspective view illustrating a piston structure of a plunger piston employed in the swashplate type compressor of the first embodiment.
Figure 3B:
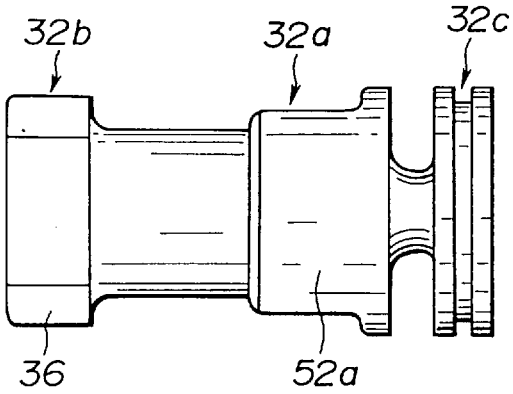
FIGS. 3A, 3B, 3C and 3D are an elevational view, a plan view, a bottom view and a left-hand side view, related to FIG. 2, respectively.
Figure 3D:
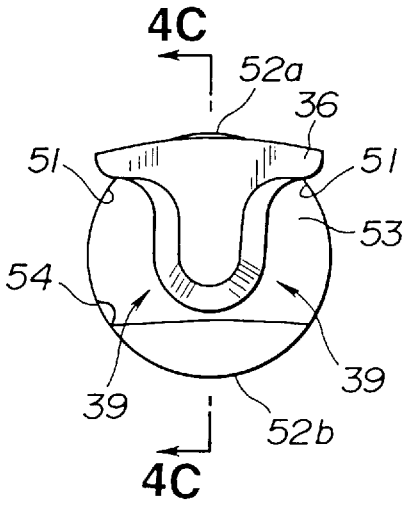
Figure 3A:
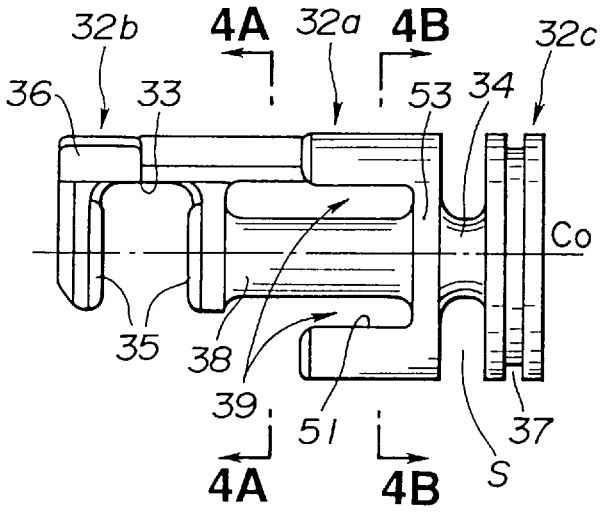
Figure 3C:
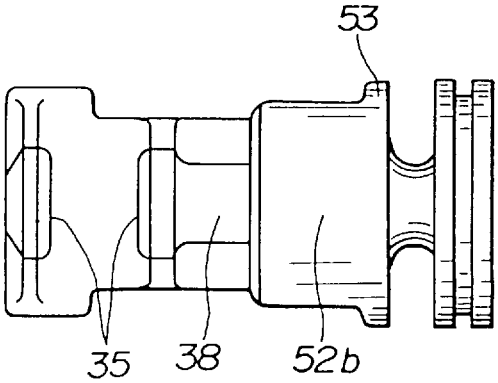
Figure 4A:
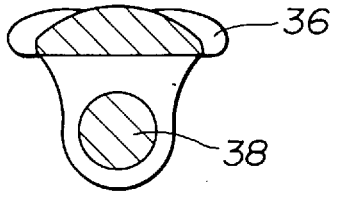
FIGS. 4A, 4B and 4C are cross-sectional views, respectively taken along line 4A—4A of FIG. 3A, line 4B—4B of FIG. 3A and line 4C—4C of FIG. 3D.
Figure 4B:
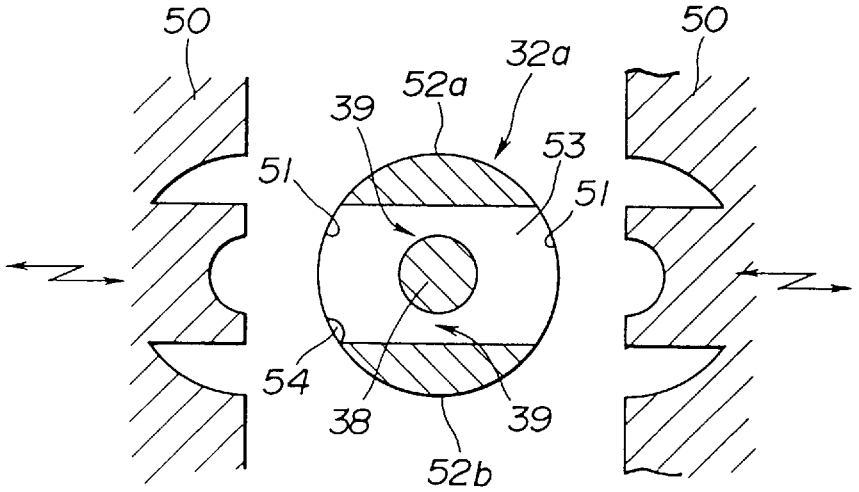
Figure 4C:
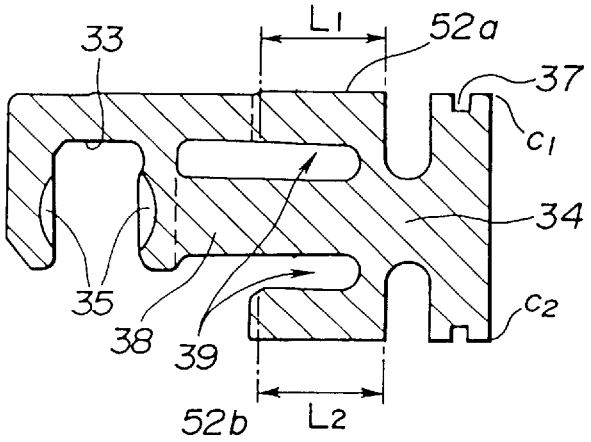

The bottom section 32*b* is formed with a substantially U-shaped recessed or notched portion 33. The bottom section 32*b* has the two opposing spherical-surface embossed portions 35 on respective opposing flat-faced sections of the U-shaped recessed portion 33. As seen in FIG. 1, each of the embossed portions 35 serves as a shoe holder for the associated semi-spherical shoe 23, with the two swashplate side walls slidably held or sandwiched between the two opposing flat surfaces of the shoes. The spherical surface of each embossed portion 35 is slidably engaged with the spherical surface of the semi-spherical shoe 23, while the flat side walls of the swash plate 43 are slidably engaged with the two opposing flat-faced surfaces of the shoes 23. Thus, such sliding engagements permit variations in the slope angle of the swash plate 43 with respect to the axis of the drive shaft 11 and the rotation of the swash plate about the ball sleeve 42, thus permitting the wobbling/rotational movement of the swash plate 43 about the drive shaft 11. When the piston 32 reciprocates axially, there is a frictional force or a sliding resistance between the side walls of the swash plate 43 and the shoes 23. On the compression stroke or on the suction stroke, one side wall of the swash plate 43 receives a great push-back force or reaction from the piston through the associated shoe 23. As can be appreciated, when the swash plate 43 rotates together with the drive shaft 11 while receiving the reaction force from the piston, each of the pistons 32 tends to rotate in the rotational direction of the swash plate owing to a sliding resistance (a friction) between the swash plate and the shoes which resistance is dependent on the magnitude of the previously-noted reaction force. That is to say, there is a moment of the reaction force about the axis of the piston 32. In other words, a certain bending moment acts on the piston 32 on the compression stroke or on the suction stroke. For the reasons set out above, the piston bottom section 32*b* is formed with a pair of circumferentially extending rotational-movement prevention portions 36 for preventing undesired rotational movement of the piston 32 by abutment between either one of the rotational-movement prevention portions 36 and the inner peripheral surface of the cylinder block 12 and for ensuring the smooth axial reciprocal sliding movement of the piston. As clearly seen in FIG. 3D, the rotational-movement prevention portions 36 are formed essentially at the lowermost end of the bottom section 32*b* and formed into an arcuate shape in a manner so as to extend circumferentially along the inner periphery of the cylinder block 12. The piston ring section 32*c* is comprised of two lands and a piston ring groove 37 defined between the two lands for fitting a piston ring into the groove 37. As appreciated from FIGS. 3A, 4B and 4C, the main skirt section 32*a* of the piston is formed with a shaft portion 38 which is aligned coaxially with respect to the axis Co of the piston 32 and extends axially from a disk-like wall portion 53 (as will be fully described later) of the main skirt section 32*a* to an inside one (in the axial direction of the piston) of the two opposing spherical-surface embossed portions 35 of the piston bottom section 32*b*. The main skirt section 32*a* is also formed with at least one through-opening 39 extending substantially in the rotational direction of the swash plate 43. In the first embodiment, two through-openings 39 are defined outside of and inside of the shaft portion 38. The provision of the shaft portion 38 contributes to an increase in a mechanical strength of the piston itself (particularly the piston bottom section 32*b*). Note that the central shaft portion 38 serves to transmit a force (axial load), which is input from the swash plate 43 through the shoe 23 to the piston bottom section 32*b*, to the piston ring section 32*c* through the connecting shaft portion 34 coaxially aligned with the central shaft portion 38 of the main skirt section 32*a*. In conjunction with the connecting shaft portion 34, the central shaft portion 38 serves to transmit a force (pressure), which is applied to the piston ring section 32*c*, through the piston bottom section 32*b* via the shoe 23 to the swash plate 43. That is, the central shaft portion 38 serves as an axial-force (axial load) transmitting member as well as a reinforcement of the piston 32. In the piston structure of the first embodiment, the shaft portion 38 is coaxially aligned with respect to the axis Co of the piston 32, for the purpose of enhancing an axial-force transmitting performance. In addition to the above, the provision of the through-opening 39 creates a pair of upstream and downstream openings (51; 51) with respect to the rotational direction of the swash plate 43. As seen in FIGS. 2, 3B, 3C, 3D and 4B, the two through-openings 39 define an outside sliding surface 52*a* and an inside sliding surface 52*b* on the outer periphery of the main skirt section 32*a*. The total area of the outside and inside sliding surfaces 52*a* and 52*b* can be reduced to a smaller value than that of the prior art piston structure of a cylindrical-hollow skirt section. The comparatively small inside and outside sliding surface areas 52*a* and 52*b* may result in a decrease in sliding resistance. As best seen in FIG. 1 and 2, the two through-openings 39 are formed to expose to the crank chamber 13. During operation of the compressor 10, there are blow-by fumes or gases escaping from the cylinder bore (or the pressure chamber defined between the piston ring section 32*c* and the suction reed valve seat 18*a*) to the crank chamber 13 via a slight aperture defined between the opposing sliding surfaces of the inner periphery of the cylinder block and the outside and inside sliding surfaces 52*a* and 52*b* of the main skirt section 32*a*. The blow-by fumes are composed of the gaseous refrigerant containing compressor-lubrication-oil mist. The oil mist is adhered to the side walls of the swash plate 43 and then the adhered oil moves radially outwardly along the swashplate side walls by way of centrifugal force. Some of the lubricating oil is brought into collision-contact with the opposing semi-spherical shoes 23 and separated from the swash plate and the shoes and then the separated lubricating oils are scattered throughout the crank chamber 13. The scattered lubricating oils can be fed via the through-openings 39 (or the upstream and downstream openings 51; 51) to the inner peripheral surface of the cylinder bores 12*a*. This results in adequate and uniform oil lubrication for the sliding surfaces between the cylinder and the piston. As a consequence, the provision of the through-openings 39 functions to enhance a wear and abrasion resistance of the piston 32 and the cylinder bore 12*a* or to prevent undesired peeling of the coated film or layer of the piston in case of a coated piston, and thus a smooth axial reciprocal sliding movement of the piston can be insured. This increases a life of the compressor. In addition, as best seen in FIGS. 3A, 3D and 4B, the main skirt section 32*a* is formed with the disk-like wall portion 53 having an axially-extending notched portion 54. The notched portion 54 is formed in such a manner as to intercommunicate the crank chamber 13 and the annular space (denoted by S) defined around the connecting shaft portion 34 between the main skirt section 32*a* and the piston ring section 32*c*. The lubricating oil can be easily supplied from the crank chamber 13 through the notched portion 54 to the annular space S, and thus the lubricating performance may be further enhanced. Assuming that the swash plate 43 is rotated in a clockwise direction (viewing FIG. 3D), the right-hand side of the outer peripheral surface of the piston tends to be strongly pressed on the inner peripheral surface of the cylinder bore, whereas the left-hand side of the outer peripheral surface of the piston tends to be scarcely affected by the sliding resistance of the swash plate. Thus, the notched portion 54 is formed at the left-hand side of the disk-like wall portion 53. As appreciated from the cross-section of FIG. 4B, the piston 32 is made of aluminum alloy by way. of die-casting. The through-openings 39 are formed by two similar split molds 50 without using a core. After die-casting, the two similar molds 50 are drawn away from the piston product in two lateral directions (toward which the two openings 51 face respectively) essentially perpendicular to the direction of the axis Co of the piston 32. In comparison with a die-cast manufacturing method utilizing a core, the aluminum-alloy piston product having a comparatively complicated shape and geometry may be easily, precisely and inexpensively formed integrally. Furthermore, the through-openings 39 contribute to reducing the weight of the piston, as well as reduction in the total sliding surface area of the main skirt section 32*a* and adequate lubrication of the compressor oil. As previously described, the bending moment is applied to the piston 32 on the compression stroke or on the suction stroke. As shown in FIG. 4C, the bending moment is received mainly by the endmost corners $c_1$ and $c_2$ of the piston ring section (the piston head section) 32*c*. The axial length $L_1$ of the outside sliding surface 52*a* and the axial length $L_2$ of the inside sliding surface 52*b* are determined in consideration of trade-off between the smooth sliding motion and the piston weight. In the shown embodiment, although the two axial lengths $L_1$ and $L_2$ are designed to be identical to each other, the two lengths $L_1$ and $L_2$ may be different from each other.

Figure 5:
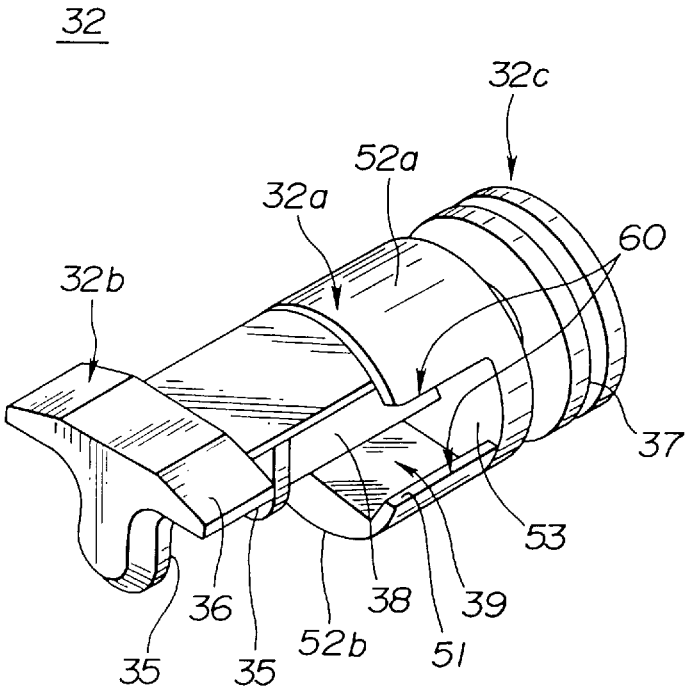
FIG. 5 is a perspective view illustrating a modification of the swashplate type compressor of the first embodiment.
Figure 6A:
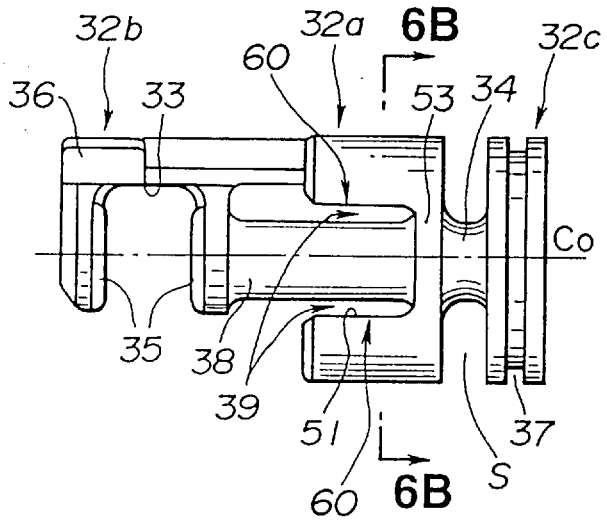
FIGS. 6A and 6B are an elevational view of the modification of FIG. 5 and a cross-sectional view taken along line 6B—6B of FIG. 6A, respectively.
Figure 6B:
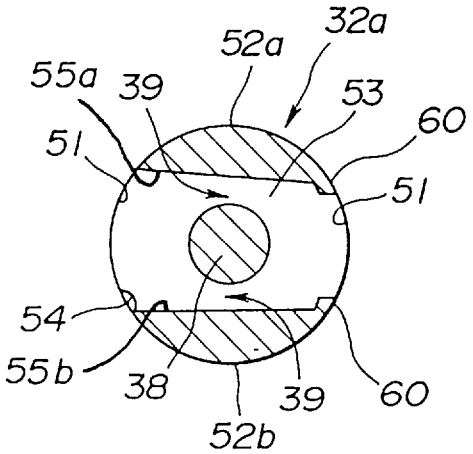

Referring now to FIGS. 5, 6A and 6B, there is shown a modification of the piston structure of the first embodiment. The modification is different from the first embodiment in that two circumferentially-extending webbed portions 60 are formed at the right-hand edge of the main skirt section 32*a* of the piston. As best shown in FIG. 6B, assuming that the swash plate 43 is rotated in the clockwise direction (viewing FIG. 6B), the left-hand side opening 51 corresponds to the upstream opening, whereas the right-hand side opening 51 corresponds to the downstream opening, with respect to the rotational direction of the swash plate 43. As previously explained, on the assumption of the clockwise rotation of the swash plate 43, the right-hand side of the outside and inside sliding surfaces 52*a* and 52*b* of the main skirt section 32*a* tends to be strongly pressed on the inner peripheral wall of the cylinder bore 12*a* during the rotation of the swash plate 43. The circumferentially-extending webbed portions 60 are formed at the strongly pressed side (i.e., the right-hand side of the piston), such that the webbed portions are contoured along the outer peripheral surface of the piston skirt. Thus, the total sliding surface area of the right-hand side (or the strongly-pressed side) of the piston skirt is designed to be greater than that of the left-hand side (or the less-pressed side). That is, the greater sliding surface area can effectively receive the side force acting on the piston during operation of the swashplate type compressor, thereby reducing a bearing pressure on the main skirt section of the piston and consequently ensuring a more smooth axial reciprocal sliding movement of the piston. As best seen in FIG. 6B, the two opposing inner peripheral wall surfaces 55*a* and 55*b* of the piston skirt section 32*a* are thinned to an extent equivalent to the total weight of the two webbed portions 60. The two opposing wall surfaces are gradually tapered (see two opposing tapered surfaces 55*a* and 55*b* illustrated in FIG. 6B) so that the distance between the wall surfaces is gradually reduced from the upstream opening 51 to the downstream opening 51 having a somewhat smaller opening area as compared with the upstream opening. Therefore, the total weight of each piston employed in the compressor 10 of the first embodiment of FIGS. 1 to 4C is identical to that of the modification shown in FIGS. 5 to 6B. As set out above, the circumferentially-extending two webbed portions 60 is effective to reduce a bearing pressure or bearing stress on the main skirt section of the piston during rotation of the compressor drive shaft 11, thus lengthening the life of the piston employed in the swashplate type compressor.

Figure 13B:
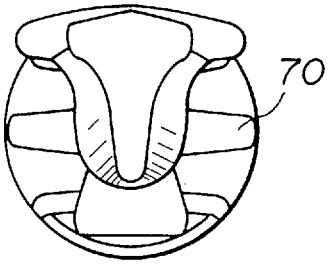
FIGS. 13A and 13B are en elevational view and a front view of another modification.
Figure 13A:
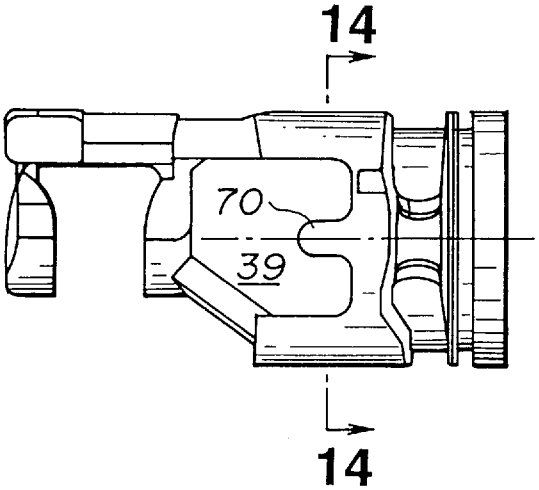
Figure 14:
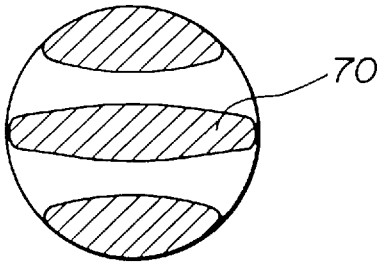
FIG. 14 is a lateral cross-sectional view illustrating the modification of FIGS. 13A and 13B, taken along the line 14—14 of FIG. 13A.
Figure 15:
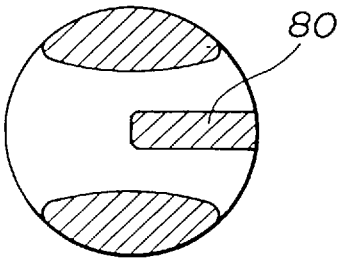
FIG. 15 is lateral cross-sectional view illustrating a further modification of the swashplate type compressor.

Referring now to FIGS. 13A, 13B, 14 and 15, there are shown another modifications somewhat similar to the webbed portions 60 of FIGS. 5, 6A and 6B. In the modification of FIG. 13A to 14, the webbed portion is comprised of an essentially horizontally, laterally-extending webbed portion 70 in such a manner as to be point-symmetrical with respect to the axis Co of the piston. Such a laterally-extending point-symmetrical webbed portion 70 is effective to reduce a bearing pressure on the main skirt section of the piston irrespective of rotational directions of the drive shaft 11 of the compressor. On the other hand, FIG. 15 shows a laterally-extending webbed portion 80 having an almost half length as large as the laterally-extending point-symmetrical webbed portion 70. In this case, the laterally-extending webbed portion 80 must be formed at the strongly pressed side for effectively receiving a greater side force (radial load), thus reducing a bearing pressure on the main skirt section of the piston during operation of the compressor.

Second Embodiment

Figure 7:
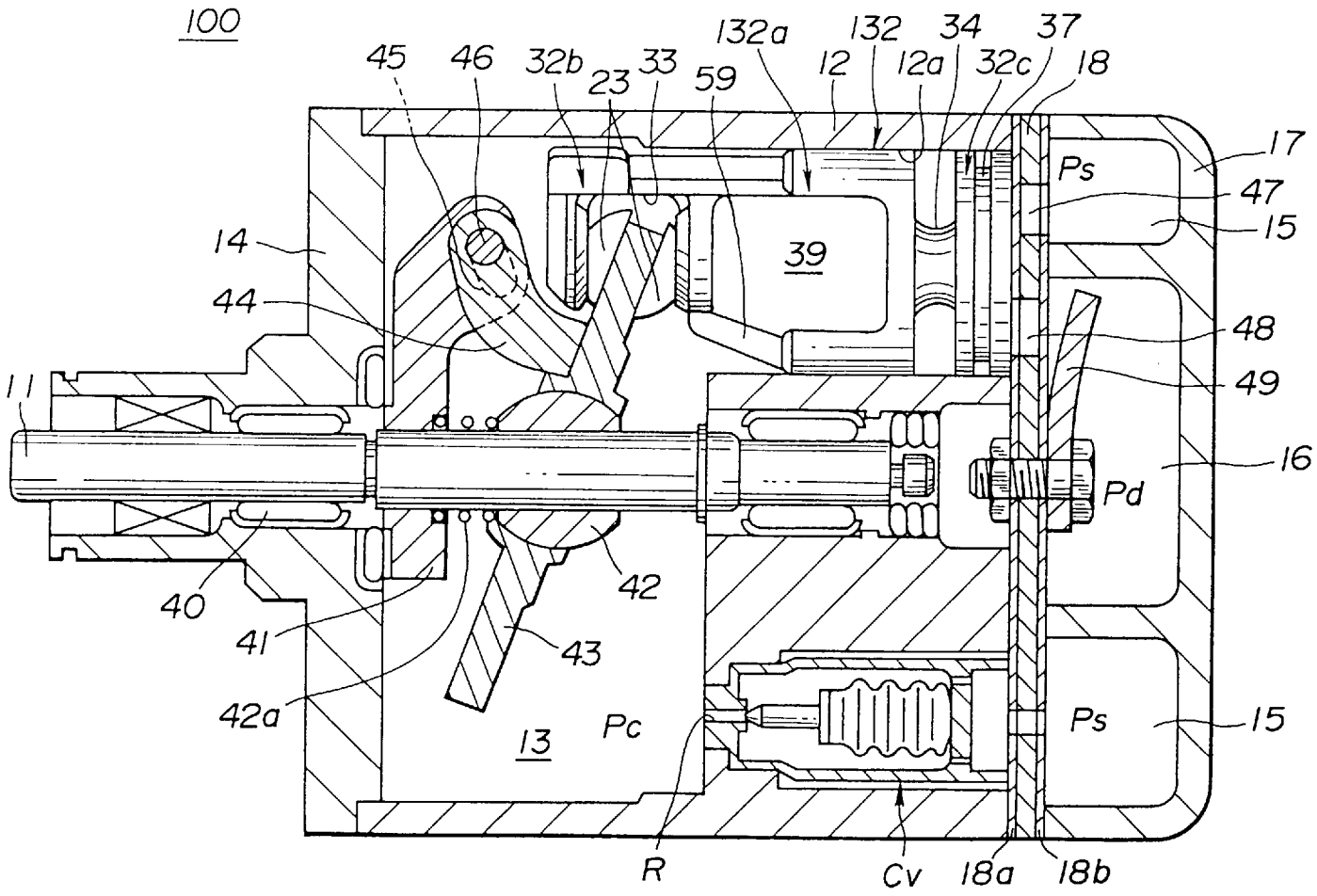
FIG. 7 is a longitudinal cross-sectional view illustrating a second embodiment of a variable displacement, swashplate type compressor made according to the present invention.
Figure 8:
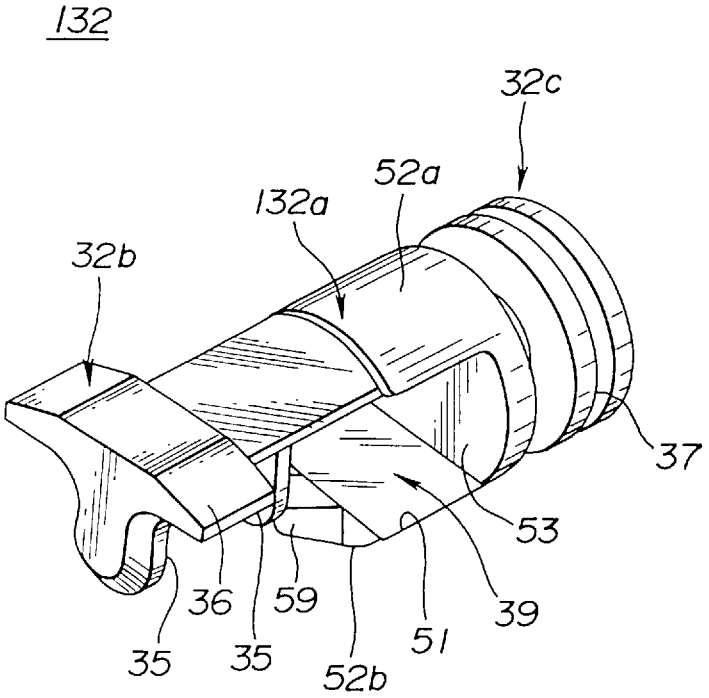
FIG. 8 is a perspective view illustrating a piston structure of a plunger piston employed in the swashplate type compressor of the second embodiment.
Figure 9B:
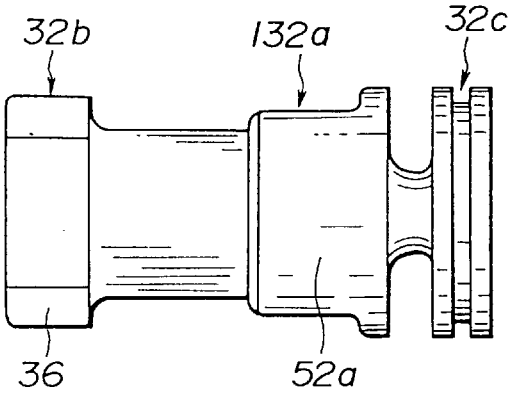
FIGS. 9A, 9B, 9C and 9D are an elevational view, a plan view, a bottom view and a left-hand side view, related to FIG. 8, respectively.
Figure 9D:
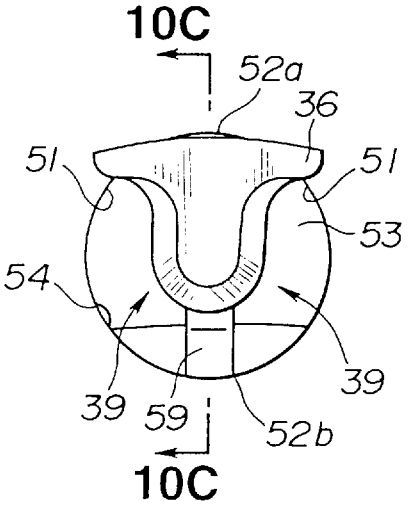
Figure 9A:
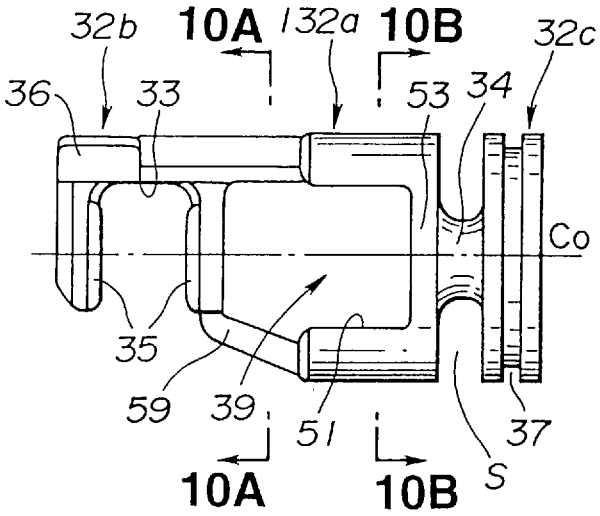
Figure 9C:
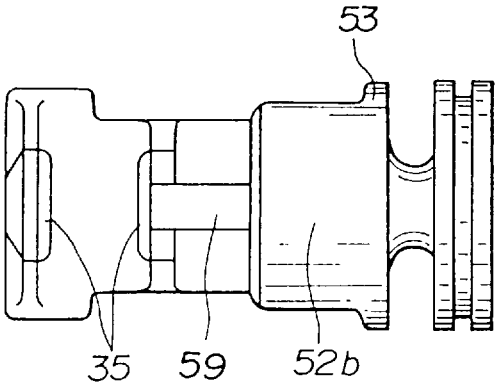
Figure 10A:
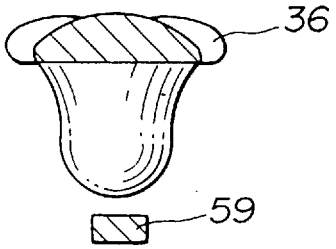
FIGS. 10A, 10B and 10C are cross-sectional views, respectively taken along line 10A—10A of FIG. 9A, line 10B—10B of FIG. 9A and line 10C—10C of FIG. 9D.
Figure 10B:
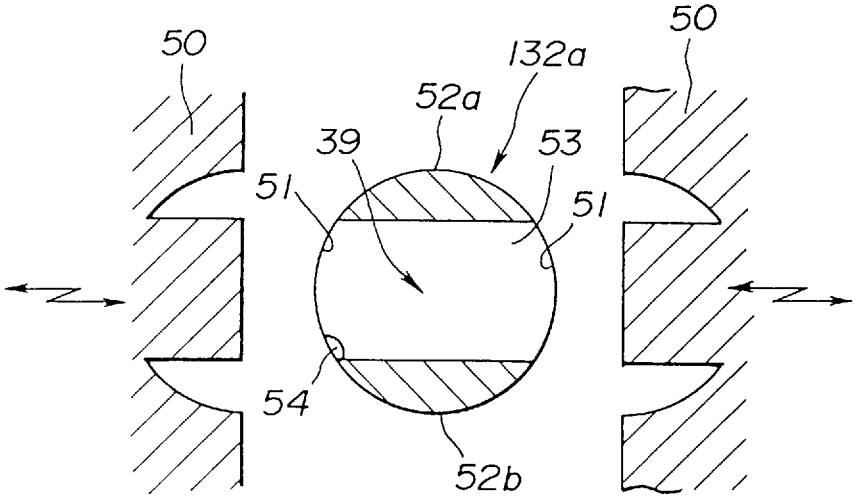
Figure 10C:
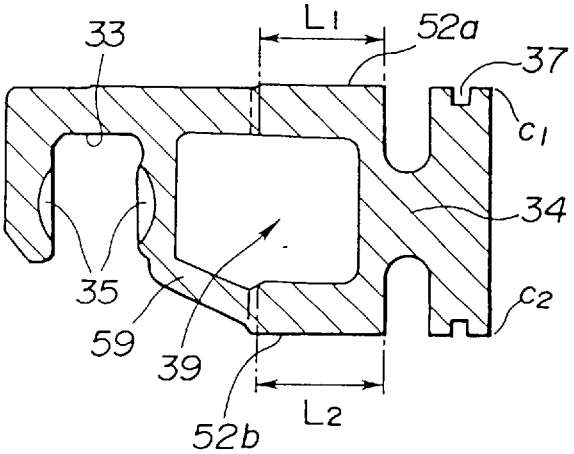
Figure 11:
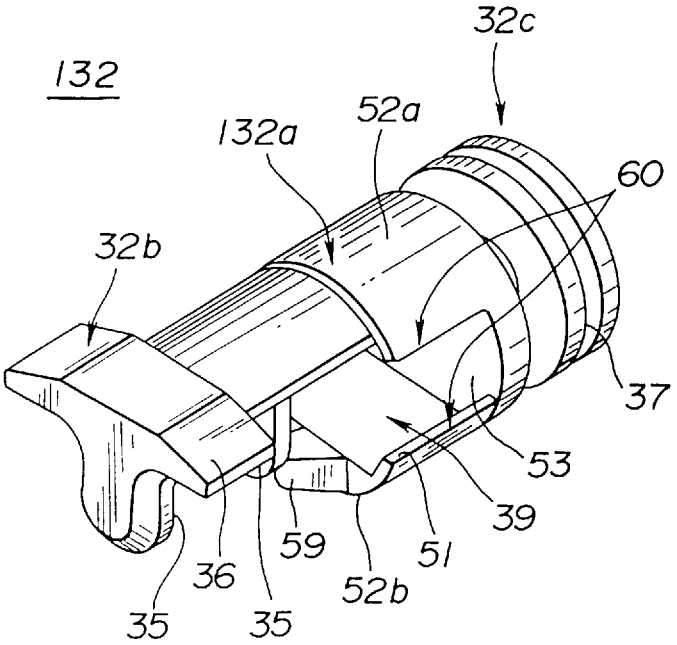
FIG. 11 is a perspective view illustrating a modification of the swashplate type compressor of the second embodiment.
Figure 12A:
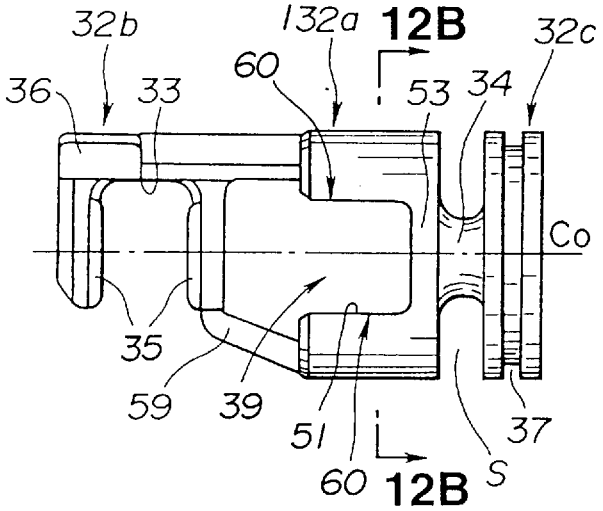
FIGS. 12A and 12B are an elevational view of the modification of FIG. 11 and a cross-sectional view taken along line 12B—12B of FIG. 12A, respectively.
Figure 12B:
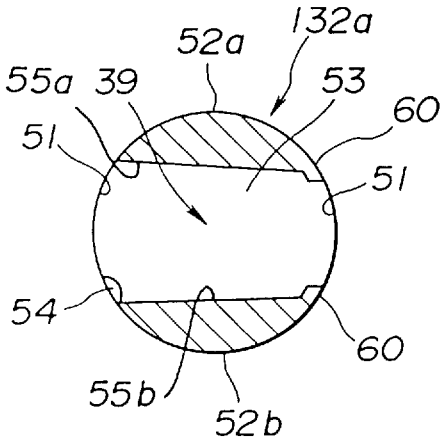

Referring now to FIGS. 7 to 10C, there is shown the variable displacement, swashplate type compressor of the second embodiment. The basic construction of the swashplate type compressor 100 of the second embodiment as shown in FIG. 7 is similar to that of the compressor 10 of the first embodiment as shown in FIG. 1. Thus, the same reference numerals used in the first embodiment of FIGS. 1 to 4C will be applied to the corresponding elements used in the second embodiment of FIGS. 7 to 10C, for the purpose of comparison between the first and second embodiments. The compressor of the second embodiment is slightly different from that of the first embodiment only in that the central shaft portion 38 of the piston 32 of the first embodiment is deleted and in lieu thereof a ribbed portion 59 is integrally formed with the piston main skirt section 132*a* of the piston 132 of the second embodiment. As can be appreciated from illustrations of FIGS. 9A, 9C, 9D and 10D, the ribbed portion 59 is integrally formed with the piston main skirt section 132*a* in such a manner that the ribbed portion 59 extends from the inside main skirt section having the inside sliding surface 52*b* to the inside spherical-surface embossed portion 35 of the piston bottom section 32*b*. The ribbed portion 59 has a function almost similar to the central shaft portion 38 of the piston structure of the first embodiment. FIGS. 11 to 12B shows a modification of the second embodiment. As can be appreciated from the comparison between a series of illustrations of FIGS. 5 to 6B and a series of illustrations of FIGS. 11 to 12B, the modification of the second embodiment is identical to that of the first embodiment, and thus the description of the modification of the second embodiment is omitted to avoid repetition.

It will be appreciated that the piston structure having both at least one through-openings 39 and a central shaft 38 (the first embodiment) or a ribbed portion 59 (the second embodiment) at the piston skirt section may be applied to a typical fixed-displacement, swashplate type compressor as well as the variable-displacement, swashplate type compressor as discussed above. In the first and second embodiments, although the piston structure of the invention is applied to a swashplate type compressor with a plurality of single headed plunger pistons, the piston structure may be applied to a swashplate type compressor with a plurality of double-headed pistons. Although the piston 32 of the first embodiment and the piston 132 of the second embodiment are produced by die-casting from aluminum alloy for the purpose of facilitation of production of the piston, the manufacturing method for producing the aluminum-alloy piston product is not limited to the die-casting. Instead of the die-casting, a piston product having a geometry and shape as illustrated in FIGS. 1 or 7 may be produced by aluminum-alloy forging (see FIGS. 13A and 13B) in order to provide a superior mechanical strength.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. The swash-plate type compressor comprising:

a drive shaft;

at least one piston;

a cylinder block rotatably supporting said drive shaft and defining therein at least one cylinder chamber, said cylinder chamber slidably accommodating said piston to permit an axial reciprocal siding movement of said piston in said cylinder chamber;

a swash plate rotatably mounted on said drive shaft; and a linkage having a driven connection with said drive shaft and drivingly connected to said swash plate for causing a rotational movement of said swash plate in synchronization with rotation of said drive shaft, while permitting a wobbling movement of said swash plate;

said piston comprising:

(a) a bottom section having a recessed portion for receiving a pair of shoes and for slidably holding side walls of said swash plate between said shoes for said axial reciprocal sliding movement of said piston; and (b) a main skirt section having a through-opening extending in a rotational direction of said swash plate, wherein said main skirt section is integrally formed with a ribbed portion extending from an inside portion of said main skirt section to said bottom section.

2. The swash-plate type compressor as set forth in claim 1, further comprising a piston head section and a connecting shaft portion connected between said main skirt section and said piston head section and coaxially aligned with an axis of said piston for transmitting an axial force applied to said piston and for defining an annular space (S) in conjunction with the inner peripheral surface of said cylinder chamber.

3. The swash-plate type compressor as set forth in claim 2, wherein said main skirt section is formed with an axially-extending notched portion for intercommunicating said crankcase chamber and said annular space (S) for lubrication of the inner peripheral surface of said cylinder chamber.

4. The swash-plate type compressor as set forth in claim 1, wherein said through-opening has upstream and downstream openings defined at upstream and downstream sides with respect to the rotational direction of said swash plate, and said upstream and downstream openings define outside and inside sliding surfaces being in sliding-contact with the inner peripheral surface of said cylinder chamber, and said main skirt section is formed with circumferentially-extending webbed portions projected from said outside and inside sliding surfaces toward said downstream opening so that said circumferentially-extending webbed portions are contoured along an outer peripheral surface of said main skirt section.

5. The swash-plate type compressor as set forth in claim 4, wherein said circumferentially-extending webbed portions formed at a strongly pressed side of said outside and inside sliding surfaces for reducing a bearing pressure on said main skirt section during rotation of said swash plate by increasing a sliding surface area of said pressed side with said circumferentially-extending webbed portions.

6. The swash-plate type compressor as set forth in claim 5, wherein an opening area of said upstream opening is greater than an opening area of said downstream opening, and said main skirt section has two opposing tapered surfaces defining therebetween said through-opening, said two opposing tapered surfaces are tapered, so that a distance between said two opposing tapered surfaces is gradually reduced from said upstream opening to said downstream opening.

7. The swash-plate type compressor as set forth in claim 6, wherein said piston is formed by die-casting with two-split molds, so that said through-opening is formed integral with said main skirt section without using a core by drawing two-split molds away from said piston in two lateral directions substantially perpendicular to a direction of the axis of said piston.

8. The swash-plate type compressor as set forth in claim 1, wherein said through-opening has upstream and downstream openings defined at upstream and downstream sides with respect to the rotational direction of said swash plate, and said upstream and downstream openings define outside and inside sliding surfaces, and said main skirt section is formed with a laterally-extending webbed portion provided substantially midway between said outside and inside sliding surfaces, so that said laterally-extending webbed portion is projected into said through-opening.

9. The swash-plate type compressor as set forth in claim 8, wherein said laterally-extending webbed portion is point-symmetrical with respect to an axis (Co) of said piston.

10. The swash-plate type compressor as set forth in claim 8, wherein said laterally-extending webbed portion is formed at a strongly pressed side of said outside and inside sliding surfaces for reducing a bearing pressure on said main skirt section during rotation of said swash plate by increasing a sliding surface area of said pressed side with said laterally-extending webbed portion.

11. The swash-plate type compressor comprising:

a drive shaft; at least one piston a cylinder block rotatable supporting said drive shaft and defining therein at least one cylinder chamber, said cylinder chamber slidably accommodating said piston to permit an axial reciprocal siding movement of said piston in said cylinder chamber;

a swash plate rotatable mounted on said drive shaft; and a linkage having a driven connection with said drive shaft and drivingly connected to said swash plate for causing a rotational movement of said swash plate in synchronization with rotation of said drive shaft, while permitting a wobbling movement of said swash plate;

said piston comprising:

(a) a bottom section having a recessed portion for receiving a pair of shoes and for slidably holding side walls of said swash plate between said shoes for said axial reciprocal sliding movement of said piston; and (b) a main skirt section having a through-opening extending in a rotational direction of said swash plate, wherein said main skirt section has a shaft portion being disposed in said through-opening and aligned coaxially with respect to an axis (Co) of said piston for transmitting an axial force input from an end of said piston.

12. A swash-plate type compressor employing an oil-mist lubrication system in which system some compressor lubricating oil is mixed in refrigerant, comprising:

a drive shaft;

at least one piston;

a cylinder block rotatably supporting said drive shaft and defining therein at least one cylinder chamber, said cylinder chamber slidably accommodating said piston to permit an axial reciprocal sliding movement of said piston in said cylinder chamber;

a swash plate rotatable mounted on said drive shaft; and a linkage having a driven connection with said drive shaft and drivingly connected to said swash plate for causing a rotational movement of said swash plate in synchronization with rotation of said drive shaft, while permitting a wobbling movement of said swash plate;

said piston comprising:

(a) a bottom section having a recessed portion for receiving a pair of shoes and for slidably holdings side walls of said swash plate between said shoes for said axial reciprocal sliding movement of said piston; and (b) a main skirt section having a through opening extending in a rotational direction of said swash plate, wherein said main skirt section is formed integral with a ribbed portion extending from an inside portion of said main skirt section (32*a*) to said bottom section.

13. A swash-plate type compressor employing an oil-mist lubrication system in which system some compressor lubricating oil is mixed in refrigerant, comprising:

a drive shaft;

at least one piston;

a cylinder block (12) rotatably supporting said drive shaft and defining therein at least one cylinder chamber and a crankcase chamber, said cylinder chamber slidably accommodating said piston to permit an axial reciprocal sliding movement of said piston in said cylinder chamber;

a swash plate rotatably mounted on said drive shaft; and a linkage having a driven connection with said drive shaft and drivingly connected to said swash plate for causing a rotational movement of said swash plate in synchronization with rotation of said drive shaft, while permitting a wobbling movement of said swash plate;

said piston comprising:

(a) a bottom section having a recessed portion for receiving a pair of shoes and for slidably holding side walls of said swash plate between said shoes for said axial reciprocal sliding movement of said piston; and (b) a main skirt section having a shaft portion aligned coaxially with respect to an axis (Co) of said piston for transmitting an axial force input from an end of said piston, and a pair of through-openings extending in a rotational direction of said swash plate, outside of and inside of the shaft portion, to feed compressor lubricating oil mist in said crankcase chamber through said through-openings to an inner peripheral surface of said cylinder chamber.

14. The swash-plate type compressor as set forth in claim 13, further comprising a piston head section (32*c*) and a connecting shaft portion (34) connected between said main skirt section and said piston ring section and coaxially aligned with an axis of said piston for transmitting an axial force applied to said piston and for defining an annular space (S) in conjunction with the inner peripheral surface of said cylinder chamber.

15. The swash-plate type compressor as set forth in claim 13, wherein said main skirt section (32*a*; 132*a*) is formed with an axially-extending notched portion (54) for intercommunicating said crankcase chamber (13) and said annular space (S) for lubrication of the inner peripheral surface of said cylinder chamber.

16. A swash-plate type compressor employing an oil-mist lubrication system in which system some compressor lubricating oil is mixed in refrigerant, comprising:

a drive shaft;

at least one piston;

a cylinder block rotatable supporting said drive shaft and defining therein at least one cylinder chamber and a crankcase chamber, said cylinder chamber slidably accommodating said piston to permit an axial reciprocal sliding movement of said piston in said cylinder chamber;

a swash plate rotatable mounted on said drive shaft; and a linkage having a driven connection with said drive shaft and drivingly connected to said swash plate for causing a rotational movement of said swash plate in synchronization with rotation of said drive shaft, while permitting a wobbling movement of said swash plate;

said piston comprising:

(a) a bottom section having a recessed portion for receiving a pair of shoes and for slidably holding side walls of said swash plate between said shoes for said axial reciprocal sliding movement of said piston; and (b) a main skirt section having a through-opening extending in a rotational direction of said swash plate for feeding compressor lubricating oil mist in said crankcase chamber through said through-opening to an inner peripheral surface of said cylinder chamber, wherein said through-opening has upstream and downstream openings defined at upstream and downstream sides with respect to the rotational direction of said swash plate, and said upstream and downstream openings define outside and inside sliding surfaces being in sliding-contact with the inner peripheral surface of said cylinder chamber, and said main skirt section is formed with circumferentially-extending webbed portions projected from said outside and inside sliding surfaces toward said downstream opening so that said circumferentially-extending webbed portions are contoured along an outer peripheral surface of said main skirt section.

17. The swash-plate type compressor as set forth in claim 16, wherein said circumferentially-extending webbed portions (60) are strongly pressed side of said outside and inside sliding surfaces (52*a*, 52*b*) for reducing a bearing pressure on said main skirt section during rotation of said swash plate by increasing a sliding surface area of said pressed side with said circumferentially-extending webbed portions (60), said pressed side being different depending upon the rotational direction of said swash plate.

18. The swash-plate type compressor as set forth in claim 17, wherein an opening area of said upstream opening (51) is greater than an opening of said downstream opening (51), and said main skirt section (32*a*; 132*a*) has two opposing tapered surfaces (55*a*, 55*b*) defining therebetween said through-opening (39), said two opposing tapered surfaces (55*a*, 55*b*) are tapered so that a distance between said two opposing tapered surfaces is gradually reduced from said upstream opening to said downstream opening.

19. The swash-plate type compressor as set forth in claim 18, wherein said piston is formed by die-casting with two-split molds (50, 50), so that said through-opening is formed integral with said main skirt section without using a core by drawing two-split molds away from said piston in two lateral directions essentially perpendicular to a direction of the axis of said piston.

20. A swash-plate type compressor employing an oil-mist lubrication system in which system some compressor lubricating oil is mixed in refrigerant, comprising:

a drive shaft;

at least one piston;

a cylinder block rotatably supporting said drive shaft and defining therein at least one cylinder chamber and a crankcase chamber, said cylinder chamber slidably accommodating said piston to permit an axial reciprocal sliding movement of said piston in said cylinder chamber;

a swash plate rotatably mounted on said drive shaft; and a linkage having a driven connection with said drive shaft and drivingly connected to said swash plate for causing a rotational movement of said swash plate in synchronization with rotation of said drive shaft, while permitting a wobbling movement of said swash plate;

said piston comprising:

(a) a bottom section having a recessed portion for receiving a pair of shoes and for slidably holding side walls of said swash plate between said shoes for said axial reciprocal sliding movement of said piston; and (b) a main skirt section having a through-opening extending in a rotational direction of said swash plate for feeding compressor lubricating oil mist in said crankcase chamber through said through-opening inner peripheral surface of said cylinder chamber;

wherein said through-opening has upstream and downstream openings defined at upstream and downstream sides with respect to the rotational direction of said swash plate, and said upstream and downstream openings define outside and inside sliding surfaces, and said main skirt section is formed with a laterally-extending webbed portion provided substantially midway between said outside and inside sliding surfaces, so that said laterally-extending webbed portion is projected into said through-opening.

21. The swash-plate type compressor as set forth in claim 20, wherein said laterally-extending webbed portion (70) is point-symmetrical with respect to an axis (Co) of said piston.

22. The swash-plate type compressor as set forth in claim 20, wherein said laterally-extending webbed portion is formed at a strongly pressed side of said outside and inside sliding surfaces for reducing a bearing pressure on said main skirt section during rotation of said swash plate by increasing a sliding surface area of said pressed side with said laterally-extending webbed portion.

* * * * *